United States Patent [19]

Shaubach et al.

[11] Patent Number: 4,854,379

[45] Date of Patent: Aug. 8, 1989

[54] VAPOR RESISTANT ARTERIES

[75] Inventors: Robert M. Shaubach; Peter Dussinger, both of Lititz; Matthew T. Buchko, Lancaster, all of Pa.

[73] Assignee: Thermacore, Inc., Lancaster, Pa.

[21] Appl. No.: 311,621

[22] Filed: Feb. 15, 1989

Related U.S. Application Data

[62] Division of Ser. No. 101,361, Sep. 25, 1987, Pat. No. 4,815,528.

[51] Int. Cl.[4] ..... F28D 15/02

[52] U.S. Cl. ..... 165/104.26; 122/366

[58] Field of Search ..... 165/104.26; 122/366

[56] References Cited

U.S. PATENT DOCUMENTS

| | | | |
|---|---|---|---|
| 3,786,861 | 1/1974 | Eggers | 165/104.26 |
| 4,058,159 | 11/1977 | Iriarte | 165/104.26 |
| 4,196,504 | 4/1980 | Eastman | 165/104.26 |
| 4,492,266 | 1/1985 | Bizzell et al. | 165/104.26 |
| 4,565,243 | 1/1986 | Ernst et al. | 165/104.26 |

*Primary Examiner*—Albert W. Davis, Jr.
*Attorney, Agent, or Firm*—Martin Fruitman

[57] ABSTRACT

A vapor block resistant liquid artery structure for heat pipes. A solid tube artery with openings is encased in the sintered material of a heat pipe wick. The openings are limited to that side of the artery which is most remote from the heat source. The liquid in the artery can thus exit the artery through the openings and wet the sintered sheath, but vapor generated at the heat source is unlikely to move around the solid wall of the artery and reverse its direction in order to penetrate the artery through the openings. An alternate embodiment uses finer pore size wick material to resist vapor entry.

3 Claims, 2 Drawing Sheets

VAPOR RESISTANT ARTERIES

The invention described herein was made in the performance of work under a NASA contract and is subject to the provisions of Section 305 of the National Aeronautics and Space Act of 1958, Public Law 85-568 (72 Stat. 435; 42 USC 2457).

This is a division of application Ser. No. 101,361, filed Sept. 25, 1987, now U.S. Pat. No. 4,815,528 granted Mar. 28, 1989.

SUMMARY OF THE INVENTION

This invention deals generally with heat transfer and more specifically with two phase heat transfer systems, known as heat pipes, which use capillary action to move the heat transport medium while it is in the liquid state.

Heat pipes are well-established devices which are used to effectively transfer heat. Their basic action depends upon using heat to vaporize a liquid within a sealed container from which non-condensible gases have been removed. The vapor then moves to another region of the enclosed volume where it is condensed because that region of the heat pipe is cooler than the heated evaporating region. Because of the high heat of vaporization of the liquid, heat is effectively moved from the evaporating region to the condensing region of the heat pipe.

However, for this heat transfer to operate on a continuing basis, the liquid which results from condensation must be returned to the region of the heat pipe where vaporization is occurring. This action can be accomplished in the simplest example by merely tilting the heat pipe so the condensing region is above the evaporating region and the liquid returns by gravity.

Frequently in the utilization of heat pipes it is necessary for the liquid to move against gravity, or in a gravity free environment. In such situations the liquid is typically moved by a porous wick structure or by liquid arteries which transport the liquid by capillary action.

A common problem with liquid arteries, such as perforated small diameter tubes or tunnels within a porous wick structure, is that, if they themselves are subjected to heat, or they approach a region of active vaporization, vapor can be generated within them or enter them to an extent sufficient to block the liquid flow action. This problem can cause the heat pipe to stop functioning or even to be destroyed.

It should be understood that for a liquid artery to function within a heat pipe there must be access for the liquid to leave the artery and enter the capillary wick somewhere in the evaporator region, and if the liquid can leave the artery, vapor can enter it, thus making vapor block possible. Furthermore, the presence of the artery in the evaporator region of the heat pipe subjects the artery to heat which tends to cause vapor generation within the artery itself, also making vapor block likely.

At least that has been the conventional wisdom until now. The present invention, however, describes arteries which are highly resistant to both vapor entry and vapor generation. By their use, heat pipes can be constructed which operate at higher powers than have generally be previously available.

The preferred embodiment of the present invention includes an artery constructed of solid tubing, but with openings in the tubing, the openings being oriented in a particular location relative to the heat source, which is also the origin of the vapor. In these arteries there are one or more openings which penetrate the artery surface which is most remote from the heat source.

For instance, in the typical cylindrical heat pipe with a sintered wick structure covering the inside surface of the cylindrical casing, the solid tube arteries are fully encased within the sintered wick so that there is at least some sintered wick between the casing and the arteries, and there is also some sintered wick between the tubes and the coaxial open vapor space in the center of the heat pipe. In such a configuration, the openings in the tubes would be located on the half of the tubing surface remote from the heat pipe casing, and preferably the openings whould be in the part of the tubing surface farthest from the casing which is the heat source.

Openings located in that manner operate to some extent as unidirectional flow devices. Liquid in the tube arteries is put in contact with sintered wick material which spans the openings in the tubing, and, by the capillary action of the porous sintered wick, the liquid is transported throughout the wick, including to the inner surface of the outside heat pipe casing.

At the evaporator portion of the casing the liquid is vaporized, and due to the gas pressure developed by vapor generation, it moves toward the central vapor space. However, vapor access to the arteries is severly restricted because the vapor would actually be required to reverse its flow direction to enter the arteries. In fact, the flow path directly to the vapor space is less restrictive than the flow path into the arteries, so the vapor does not enter the arteries.

Moreover, since the arteries are constructed of solid tubing surrounded by sintered wick as opposed to the more typical open tunnels within sintered wick, the thermal conductivity of the more dense tubing is greater than the typical tunnel surface. This reduces the likelihood of excessive boiling within the arteries will more easily be dissipated along the length and around the circumference of the tubing.

A further advantage of the solid tubing is the smoothness of the tubing as compared to the walls of a tunnel formed within the wick itself. Because of the smoother surface of the inside of the tubing, it is less likely that boiling will begin than it would be when the walls consist of bonded porous material. This is because the smoother surface has smaller nucleation sites, and as the size of those sites decreases the amount of heat required to initiate boiling within the artery itself increases.

An alternate embodiment of the invention which also aids in reducing boiling is one which includes a second layer of a wick of finer pores coating the inside of an artery formed in a surrounding coarser pore wick. This structure also prevents vapor from entering the artery because the preferential vapor flow path is always through the wick portion with the larger pore size. Thus, vapor generated at or near the heat pipe causing will travel around the artery constructed of finer pores to reach the vapor space of the heat pipe, because it has a complete direct path of coarser wick, rather than attempt to penetrate into the finer pores around the artery.

This occurs because the coarser wick has less surface tension force than the finer wick, and thus the preferential vapor flow path is through the coarser wick.

The present invention therefore results in a heat pipe structure whose arteries are much less susceptible than other structures to blockage by vapor, both because boiling is less likely within the arteries and because vapor generated in the porous wick structure is less likely to enter the arteries. The significance of this benefit is that the heat pipe can be operated at a higher power level than conventional heat pipes before its heat transfer is limited by vapor blocking.

DETAILED DESCRIPTION OF THE INVENTION

Figure 1:
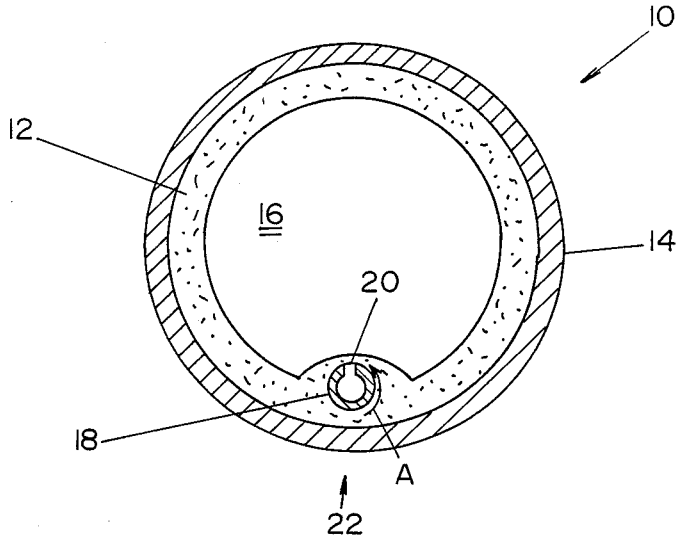
FIG. 1 is a cross section view of a heat pipe of conventional cylindrical configuration with an artery constructed according to the preferred embodiment of the invention.

The preferred embodiment of the invention is shown in FIG. 1 as a cross section view across the axis of conventional cylindrical heat pipe 10 in which sintered wick 12 covers the inside surface of heat pipe casing 14 and encloses vapor space 16. Liquid artery 18 with opening 20 is constructed of solid walled tubing and is encased within sintered wick 12 and oriented so that opening 20 in the surface of artery 18 is located on the side of artery 18 which is most remote from heat source 22 on casing 14. Sintered wick material 12 actually spans or fills opening 20 in artery 18, so that in a sense opening 20 is not a true opening, but rather a discontinuity of surface material. This permits artery 18 to continue to act as a capillary transport structure in the axial direction of heat pipe 10, but nevertheless permits liquid from within artery 18 to contact sintered wick 12 and, by the capillary action of wick 12, to be distributed to all portions of wick 12, particularly that portion directly between artery 18 and the nearest area 22 on casing 14.

Assuming, in the worst case for vapor blockage problems of artery 18, that area 22 of casing 14 is also the sole source of heat for heat pipe 10, in the usual heat pipe, vapor generated on the inside surface of area 22 of casing 14 would be the most likely to enter artery 18. However, since artery 18 is a solid wall in the region where it approaches area 22, the vapor is deflected around the cross section of artery 18, as shown by path A. Moreover, when the flowing vapor reaches the far side of artery 18 where there is access to the interior, the normal flow direction and velocity will carry it past opening 20 and into vapor space 16. This results not only from the fact that entry into artery 18 would require a reversal of flow direction, but also because the resistance to flow through wick 12 is likely greater in the direction into artery 18 than in the direction into vapor space 16.

Therefore, by the simple device of limiting openings in artery 18 to the surface remote from the heat source, the artery becomes highly resistive to vapor entry.

Additional benefit is derived from constructing artery 18 of solid, or at least more dense, material than the material of the sintered wick. When such material is used as an artery as opposed to merely producing a tunnel in sintered wick 12, not only is access to undesirable vapor flow cut off, but heat conductivity of the artery wall is increased. Therefore, heat which directly contacts the artery wall and could cause localized boiling and vapor which blocks the artery, is conducted and dissipated axially along the artery. Boiling is therefore less likely.

Figure 2:
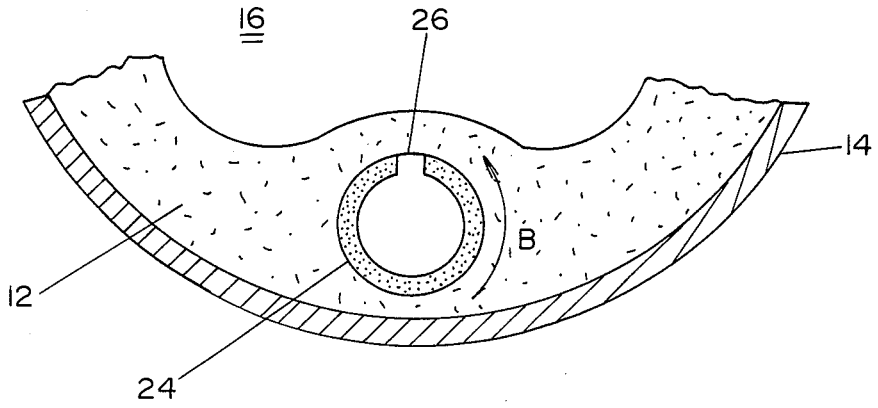
FIG. 2 is a cross section view of an alternate embodiment of the invention which uses a smaller pore size material to form the artery and prevent vapor entry.

FIG. 2 shows an enlarged axial cross section of an alternate embodiment of the invention in which only the construction of artery 24 differs from the depiction in FIG. 1. Artery 24 is constructed not of solid tubing as is artery 18 in FIG. 1, but rather of sintered material similar to, but of smaller pore size than, the material of wick 12.

The smaller pore size of artery 24 functions in a manner similar to the solid wall of artery 18 in FIG. 1 in that it resists vapor entry. Proper selection of the smaller pore size assures that the vapor generated at the casing surface nearest artery 24 has a less resistive flow path to vapor space 16 through wick 12 than through the walls of artery 24. Therefore path B is the preferred path for vapor, and the overall effect of an artery with finer pores than the main wick is the same as that of an artery with solid walls.

Moreover, the finer pores result in a more dense wall structure and, similar to the solid tubing, they also furnish increased thermal conductivity to reduce boiling in the artery.

Artery 24, constructed of sintered material with finer pores than wick 12, does, however, have one advantage over the solid tubing artery. The presence of a pore structure, even though finer than the wick, makes it possible to transport liquid directly through the walls of artery 24 into wick 12. This property makes it possible to fulfill the liquid distribution function of artery 24 without any other opening in the artery wall. Therefore, in some applications, when a finer pore artery is used, opening 26 in the wall of artery 24 most remote from the heat source is not absolutely required and is merely optional.

Figure 3:
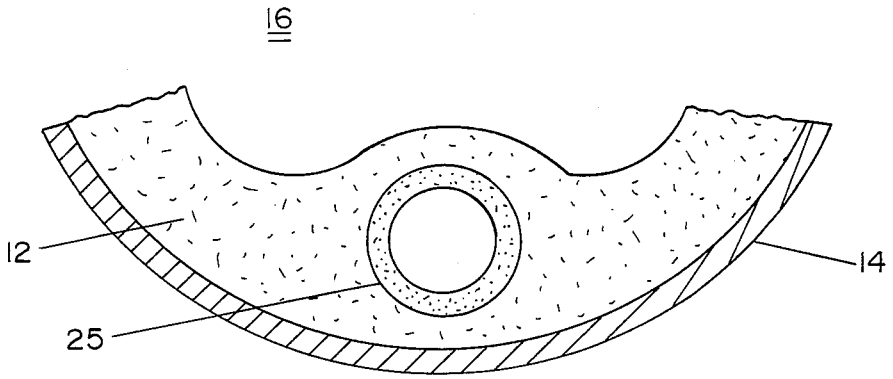
FIG. 3 is a cross section of another embodiment of the invention which uses a smaller pore size artery but has no slot in its structure.

Such an embodiment is depicted in FIG. 3 in which artery 25, which is constructed of finer pores than wick 12, is continuous and has no slot at all in its structure.

Figure 4:
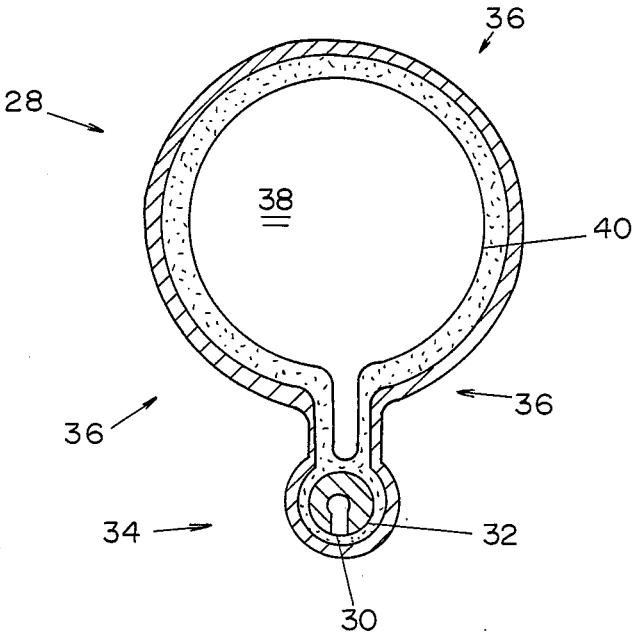
FIG. 4 is a cross section view of an external artery heat pipe with an artery embodying the present invention.

FIG. 4 is an across-the-axis cross section view of external artery heat pipe 28 with an artery embodying the present invention. It is of particular interest because the orientation of opening 30 in solid tubing artery 32 would appear, at first glance, to be different than the orientation of artery 18 in FIG. 1. In fact, however, opening 30 meets the same criteria previously discussed.

Since the typical goal of an external artery heat pipe such as heat pipe 28 is to isolate external artery structure 34 from effect by heat sources 36, opening 30 in artery 32 is on the side most remote from the heat source. Despite the fact that opening 30 in artery 32 is also aiming away from vapor space 38 it functions to supply liquid to wick 40, and that is its purpose.

It is to be understood that the form of this invention as shown is merely a preferred embodiment. various changes may be made in the function and arrangement of parts; equivalent means may be substituted for those illustrated and described; and certain features may be used independently from others without departing from the spirit and scope of the invention as defined in the following claims.

For example, the openings in the artery could be either holes or slots and need not be oriented parallel to the artery axis. Moreover, they need not be located exactly opposite the heat source, but could be anywhere on the artery side remote from the heat source.

What is claimed as new and for which Letters Patent of the United States are desired to be secured is:

1. A heat pipe comprising:

a sealed casing;

capillary wick means located adjacent to the inside surface of the casing;

vaporizable heat transfer fluid within the sealed casing; and at least one artery located within and surrounded by the capillary wick means, the artery constructed of walls of solid material and including at least one opening within the solid walls, the opening being oriented so that it is in a surface of the artery which is remote from a heat source applied to the heat pipe.

2. The heat pipe of claim 1 wherein the artery is constructed in the configuration of circular cross section tubing.

3. The heat pipe of claim 1 wherein the artery is located within an extension to the heat pipe casing which protrudes from the heat pipe casing in a radial direction.

* * * * *